US009943727B2

(12) United States Patent
Giovannotto

(10) Patent No.: US 9,943,727 B2
(45) Date of Patent: Apr. 17, 2018

(54) SEMI-RIGID FOOT POCKET WITH NON-INVASIVE FLIPPER ATTACHMENT SYSTEM

(71) Applicant: Peter Stefano Giovannotto, Palo Alto, CA (US)

(72) Inventor: Peter Stefano Giovannotto, Palo Alto, CA (US)

( * ) Notice: Subject to any disclaimer, the term of this patent is extended or adjusted under 35 U.S.C. 154(b) by 0 days.

(21) Appl. No.: 15/331,871

(22) Filed: Oct. 23, 2016

(65) Prior Publication Data

US 2017/0113098 A1 Apr. 27, 2017

Related U.S. Application Data

(60) Provisional application No. 62/245,266, filed on Oct. 22, 2015.

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/11; A63B 31/02; A63B 31/04; A63B 31/08; A63B 31/10; A63B 2031/112
USPC ..... 441/61, 62, 63, 64
See application file for complete search history.

(56) References Cited

U.S. PATENT DOCUMENTS

| | | | | |
|---|---|---|---|---|
| 4,599,071 | A * | 7/1986 | Juang | A63B 31/11 441/61 |
| 6,884,136 | B1 * | 4/2005 | McCarthy | A63B 31/00 441/64 |
| 7,140,938 | B1 * | 11/2006 | Ware | A63B 31/11 441/64 |
| 9,440,114 | B2 * | 9/2016 | Ortwig | A63B 31/11 |
| 2002/0037677 | A1 * | 3/2002 | Gibbons | A63B 31/11 441/64 |
| 2005/0153607 | A1 * | 7/2005 | Burns | A63B 31/11 441/63 |

FOREIGN PATENT DOCUMENTS

| | | | | |
|---|---|---|---|---|
| EP | 2058032 | A1 * | 5/2009 | A63B 31/11 |

* cited by examiner

*Primary Examiner* — Anthony D Wiest
(74) *Attorney, Agent, or Firm* — Gokalp Bayramoglu

(57) ABSTRACT

The invention is a semi-rigid adjustable diving foot pocket with a clamping system to allow simple attachment and detachment of a multitude of various flippers/blades. This foot pocket is adjustable to the foot and is semi-rigid to allow partial medial rotation, but very limited lateral rotation. The flippers secured to the foot-pocket by a system utilizing clamping pressure to hold the flipper in place. This system allows for the flipper to be attached and detached easily, with no damage occurring to either the invention or the flipper.

10 Claims, 7 Drawing Sheets

SEMI-RIGID FOOT POCKET WITH NON-INVASIVE FLIPPER ATTACHMENT SYSTEM

RELATED APPLICATIONS

This application claims priority to U.S. Provisional Patent Application No. 62/245,266 titled "Semi-Rigid Foot Pocket with Non-Invasive Flipper Attachment System" filed on Oct. 22, 2015, to which Applicant claims the benefit of the earlier filing and which is incorporated herein by reference in its entirety.

FIELD OF THE DISCLOSURE

The present invention relates to an underwater swimming aid. More particularly, the present invention relates to a semi-rigid foot pocket with non-invasive flipper attachment system.

BACKGROUND

Currently, underwater swimming aids that attach only to the feet have two main subsections: 1) those where the foot pocket and flipper/blade are permanently attached and sold as one unit, or 2) where molded rubber pockets are sold separately from the flipper/blade and is later semi-permanently attached to the molded foot pocket. The present invention is directed towards the latter subsection of underwater swimming aids that attach only to the feet, in the present state of the art, flippers are attached to simple and molded rubber foot pockets in such a way that, once attached, the foot pocket and flipper cannot be removed from each other without catastrophic damage to the foot pocket, flipper, or both. Typically, the flipper and foot pocket are attached by the use of permanent resins or permanent attachment via drilling holes in the flipper and securing the flipper to the foot pocket with screws. There currently exists no simple, removable system to attach and detach a flipper to a foot pocket. Given that the flipper and foot pocket have no method of interchangeability, the current situation is inconvenient and wasteful. If a purchased combination of foot pocket and flipper is unsatisfactory, there is currently no way to replace either the foot pocket or flipper without catastrophic damage occurring to the foot pocket, the flipper, or both. If one portion of the foot pocket and flipper system is damaged, there is no way to replace only that portion of the foot pocket and flipper system.

SUMMARY OF THE INVENTION

The invention resolves the aforementioned issues by utilizing a system in which the flipper does not require any permanent form of attachment. Instead, this system provides secured housing for the flipper during use in a method that is both removable and non-damaging to the flipper and foot pocket after use of the system. The method of attachment to the flipper eliminates the need for permanent resins or drilling to affix a flipper to the foot pocket. This system allows the possibility of interchangeability between different flippers without damaging any part of the system.

This foot pocket also provides greater power transfer from the diver to the flipper because the foot pocket will have a better fit. The foot pocket is adjustable to create a better fit on the foot, thus facilitating a better transfer of power from the diver's kick to the flipper. A better fit also reduces the amount of unnecessary lateral movement within the foot pocket, which can cause power transfer loss and even blisters. The foot pockets can be created in several sizes, much like with any standard athletic shoe. The diver will step into the foot pocket system, and then use a secured system consisting of several ratcheting buckles, to secure and tighten the foot pocket to the foot.

DETAILED DESCRIPTION OF THE INVENTION

Hereinafter, the disclosure is described in conjunction with the figures and embodiments.

Figure 1:
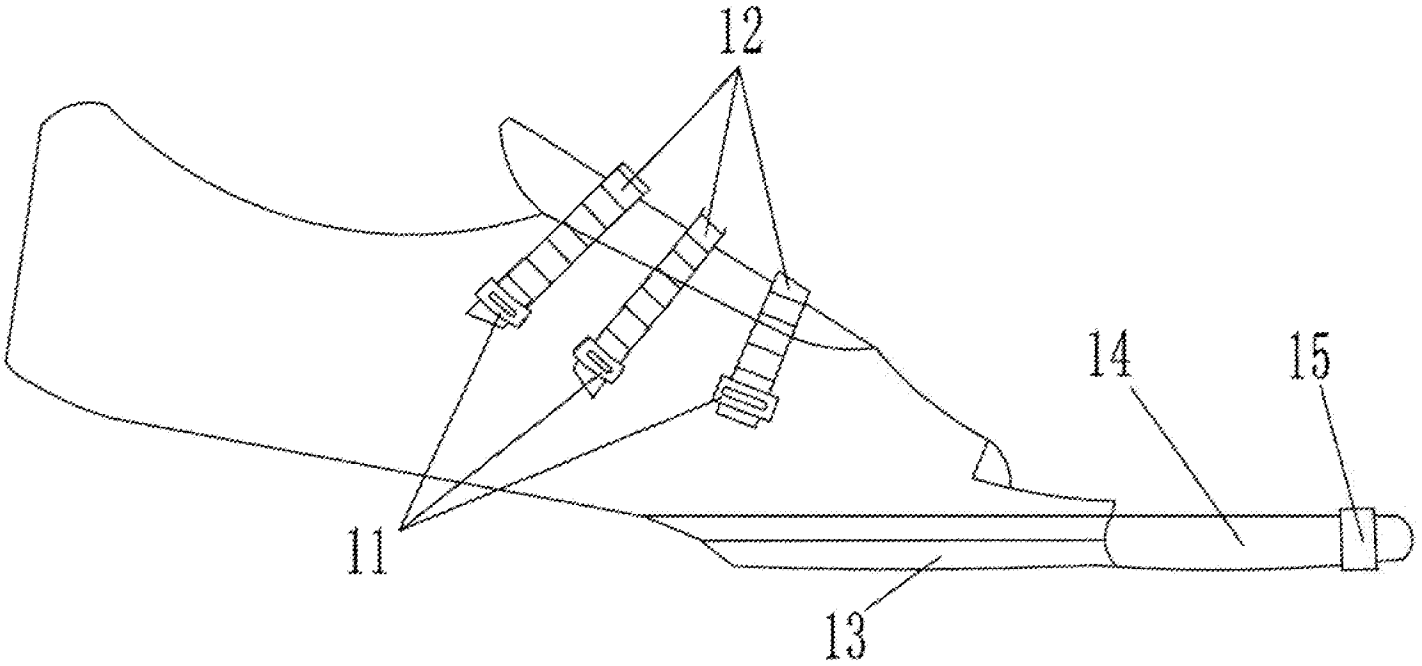
FIG. 1 shows the outside exterior of the invention. In this figure, a majority of the components are shown, including the straps (12), buckles (11), attachment plate (13), flexible tendons (14) and tendon clips (15).

FIG. 1 shows an outside, exterior view of the invention. The a (11) and straps (12) create a secure method of attaching the semi-rigid foot pocket to the foot. A majority of the components which are required to attach a flipper to the foot pocket are also shown, including the attachment plate (13) on which the rear of the flipper rests, along with the flexible tendons (14) and tendon clips (15). Absent from this view are the mounting screws (41) which will be shown in later figures. There are a few items to note in this figure:

It is also important to note that the flexible tendons (14) are a component of the attachment plate (13), rather than the foot pocket itself. This allows the user to replace the attachment plate (13), rather than the entire foot pocket, if there is damage or excessive wear to the flexible tendons.

Flexible tendons (14) are needed within the system to distribute the immense force created by a diver's kicking motion. Without these tendons, all force from as kick would be transferred to the small, localized connection points of the flipper and foot pocket. Given the force exerted to the flipper when a diver kicks through the water, repetitive use of a foot pocket without tendons will eventually cause catastrophic failure at location where the flipper is connected to the foot pocket. Tendons distribute the force of a kick more evenly across the surface of the flipper. This results in a more consistent transfer of energy along the flipper, and greatly decreases the force upon any particular section of the flipper, eliminating the possibility of eventually breaking the flipper during use.

Flexible tendons (14) allow the invention to accommodate a variety of flippers. For example, many flippers for free diving contain an angle between 0-24 degrees. With a rigid tendon, it would be impossible to attach a flipper with any angle in the blade. A flexible tendon can be bent to accommodate any angle within a flipper.

The foot pocket housing is made of rigid plastic, with an open toe in the housing. The rigid structure of the foot pocket housing is critical, as the stiffer design facilitates a higher amount of power transfer from the foot to the flipper. An open toe design allows all water to freely pass through the foot pocket housing.

Figure 2:
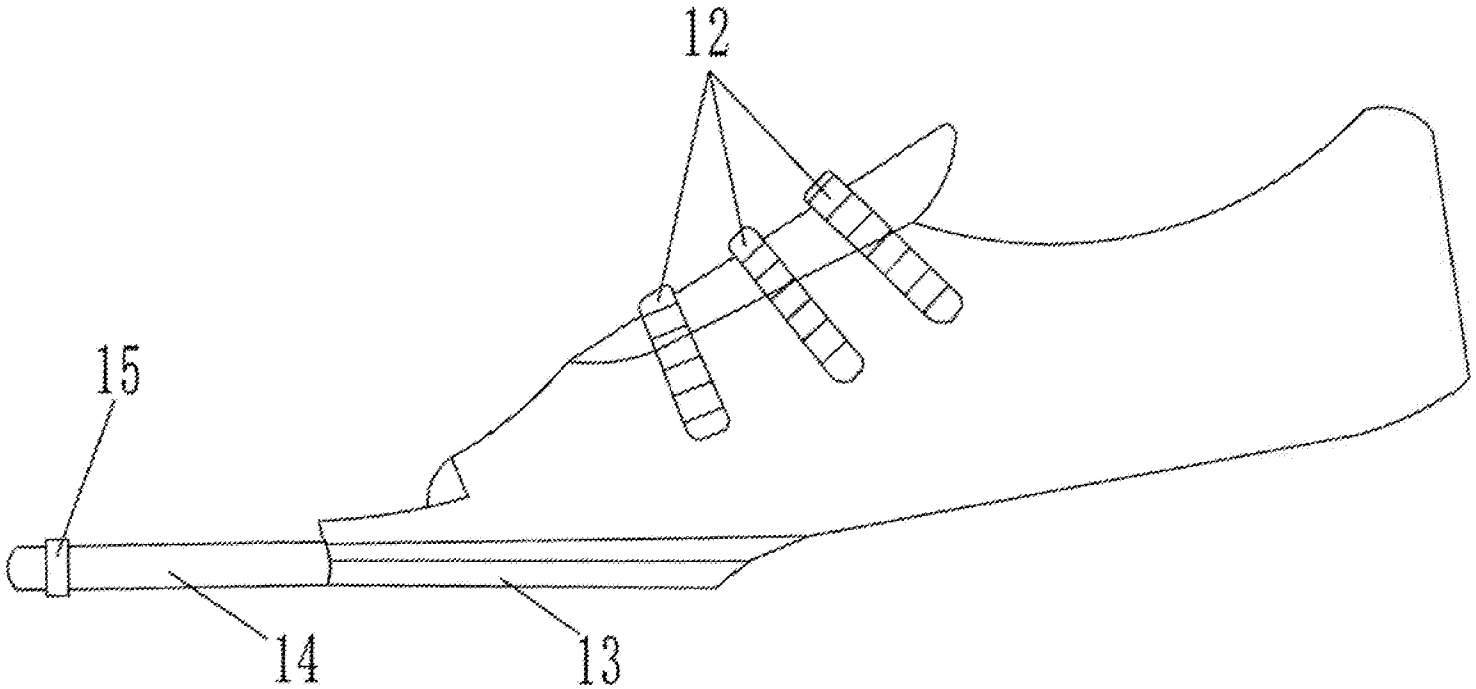
FIG. 2 shows the inside exterior view of the invention. In this view, the straps (12), attachment plate (13), flexible tendons (14) and tendon clips (15) are shown.

FIG. 2 shows the inside exterior of the invention. This figure shows many of the same components as FIG. 1. The main item to note in this figure is that there is an inside/exterior view of the foot pocket because the foot pocket will have a left and right foot so as to be more comfortable to the wearer. In the prior art, foot pockets do not have a left or right foot, but are a single shape for both feet. Having a left and right foot pocket will create a more comfortable fit for the user, and a tighter, better fit will maximize the power transfer from the diver's foot to the foot pocket.

Figure 3:
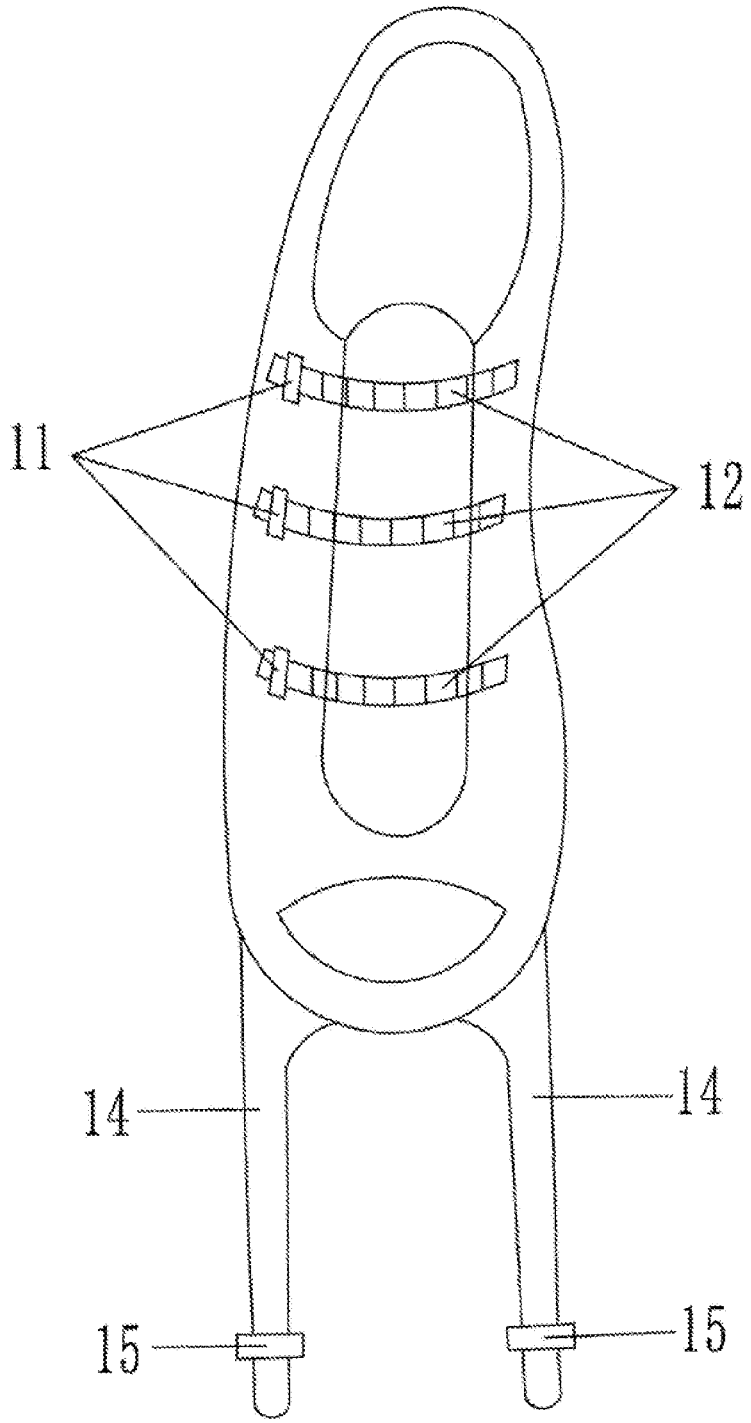
FIG. 3 shows an above view of the invention, in this figure, the straps (12), buckles (11), flexible tendons (14) and tendon clips (15) are shown.

FIG. 3 shows a view of the invention from above. In this view, it becomes easy to see a complete view of the invention. Flexible tendons (14) are clearly shown in this figure. One item to note in this figure is the use of tendon clips (15). Tendon clips serve a vital role in the invention. In the prior art, most manufacturers rely on permanent resins or epoxy to secure the tendons to a flipper. This invention instead relies on the clamping pressure created by the tendon clips (15) to essentially pinch the flexible tendons (14) onto the flipper. Using tendon clips allows a user to avoid the use of resins or epoxy, which allows the flipper to be removed without damage to the edge of a flipper or the invention.

Figure 4:
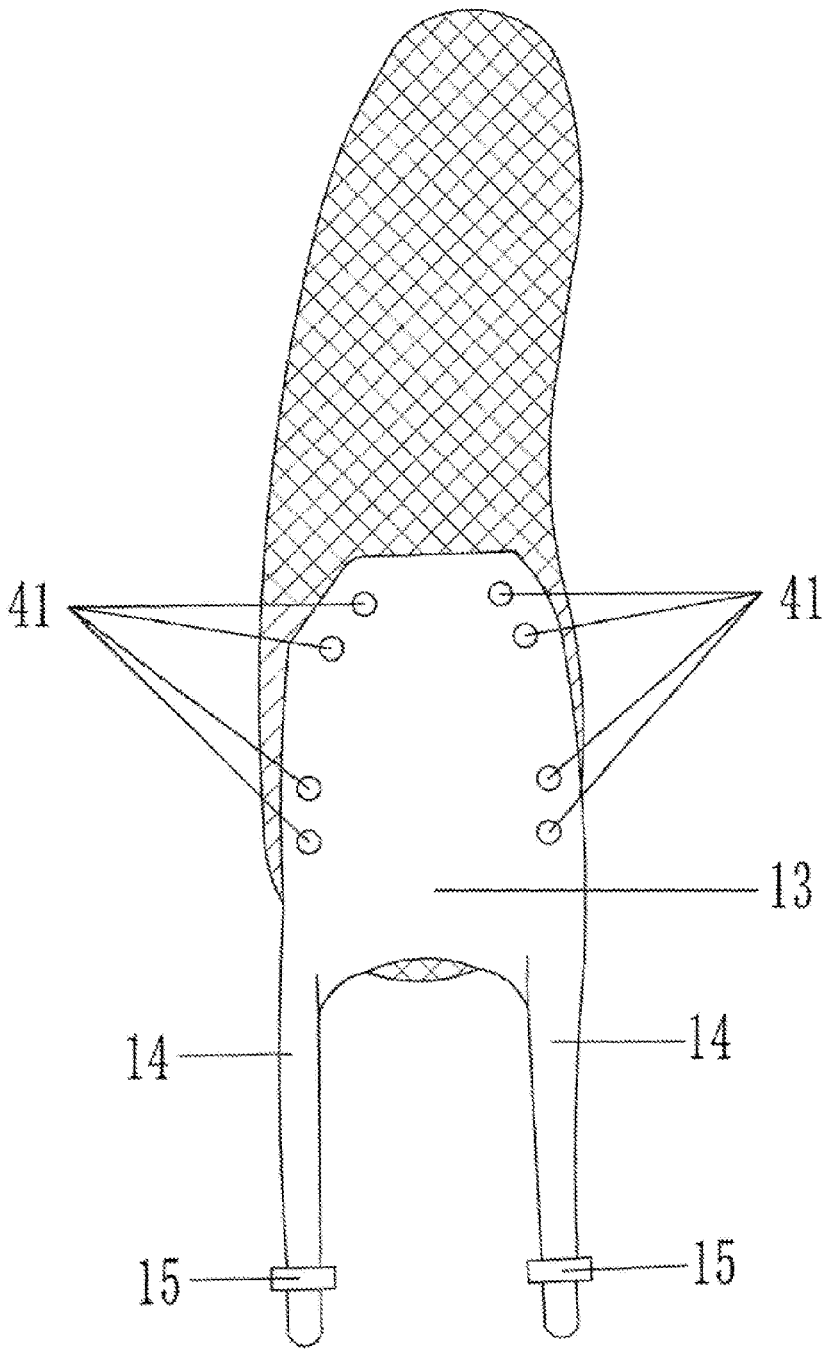
FIG. 4 shows a view from below the invention. This figure shows the attachment plate (13) with mounting screws (41), as well as the flexible tendons (14) and tendon clips (15).

FIG. 4 shows a view of the invention from below. This figure is important because it presents a clear figure of the attachment plate (13) and the mounting screws (41). In this figure it also becomes clear that the flexible tendons (14) and tendon clips (15) are characteristics of the attachment plate (13) rather than the foot pocket itself.

The mounting screws are the driving attachment point between the flipper and the invention. The mounting screws are arranged in such a way that they do not directly touch the rear of the flipper. Instead, the mounting screws are arranged in several places around the perimeter of the flipper and rely on the pressure created by the mounting screws to keep the flipper in place. Placing several mounting screws around the flipper also creates a larger attachment area than traditional foot pocket attachment points.

In the prior art, typically, a flipper is slid into an opening below the foot pocket, and then the rear of the flipper is drilled and directly attached to the foot pocket. Unfortunately, the attachment location for the flipper varies from manufacturer to manufacturer, so by drilling the flipper as part of the attachment process, the flipper is essentially forever paired to a particular foot pocket from that point forward.

This system does not require any drilling, and thus the flipper can be removed by simply removing the mounting screws. No damage is imparted to the flipper with this method of attachment.

Figure 5:
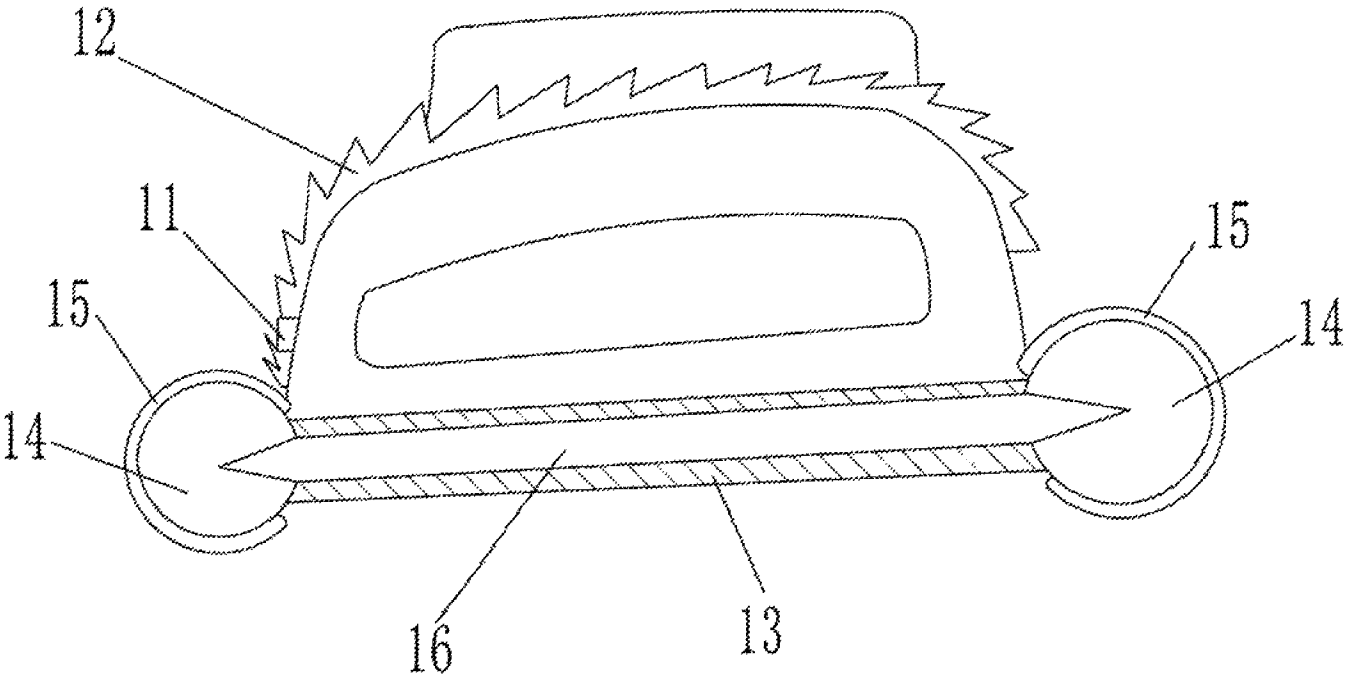
FIG. 5 shows a cross-view of the invention. This figure shows the route in which a flipper can be attached to the invention. Key components in this system are the attachment plate (13), flexible tendons (14) and tendon clips (15). Also shown are the straps (12), buckles (11), and the space (16) in which to slide the flipper.

FIG. 5 shows a cross section of the invention. In this figure, the method of flipper attachment is clearly shown for the first time. To attach to flipper, one simply needs to slide the rear of the flipper into the space 16 between the foot pocket and the attachment plate 13. Once the flipper is in place, the mounting screws (41) are tightened to secure the flipper. After the flipper has been secured, the flexible tendons (14) are mounted to the edges of the flipper and are kept in place by the clamping pressure created by the tendon clips (15).

Figure 6:
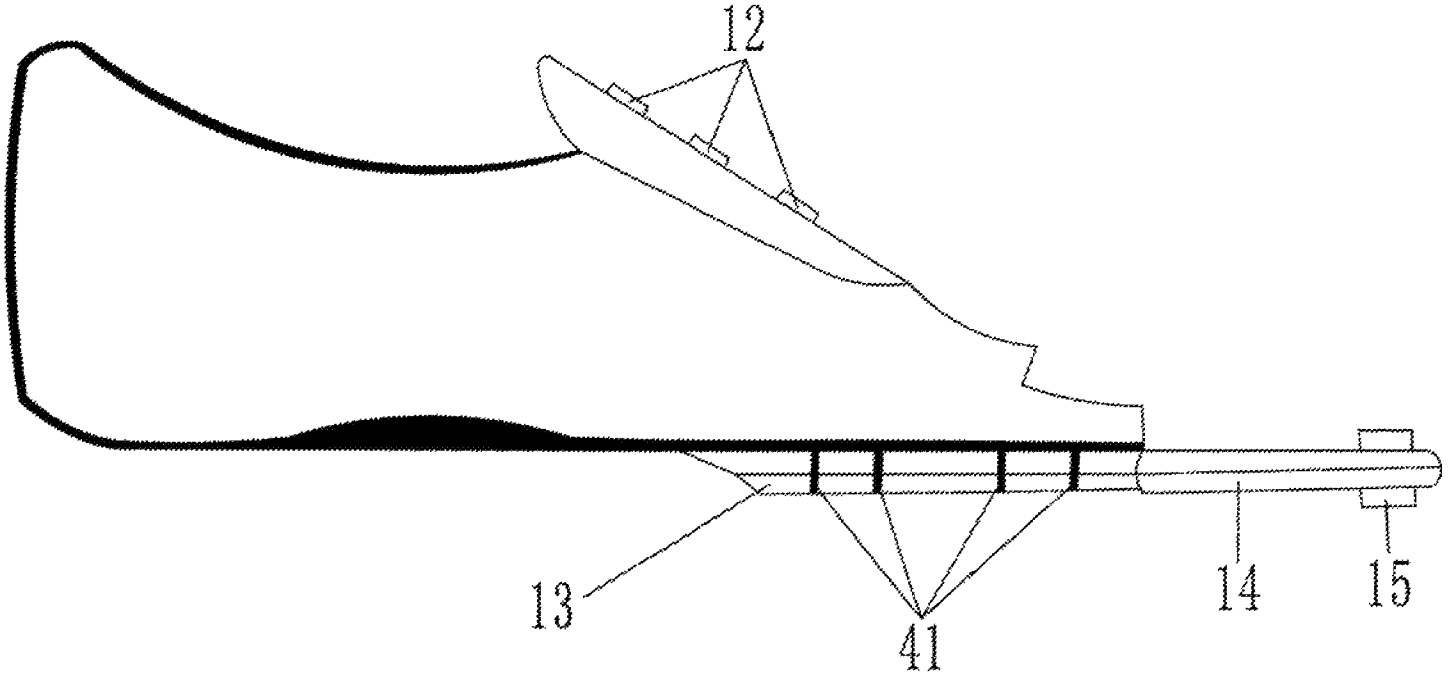
FIG. 6 shows a lateral cross-section of the invention. Shown are the straps (12), attachment plate (13) with mounting screws (41) in place, flexible tendon (14) and tendon clips (15).

FIG. 6 shows a lateral cross-section of the invention. In this figure, it is important to note that the mounting screws (41) begin at the attachment plate (13) and terminate near the end of the mounting plate in the foot pocket. This creates a secure fit between the foot pocket and the attachment plate. This figure also shows the aperture on the inside of the flexible tendon (14), which will attach to the outside of the flipper. The tendon clips (15) is also shown.

Figure 7:
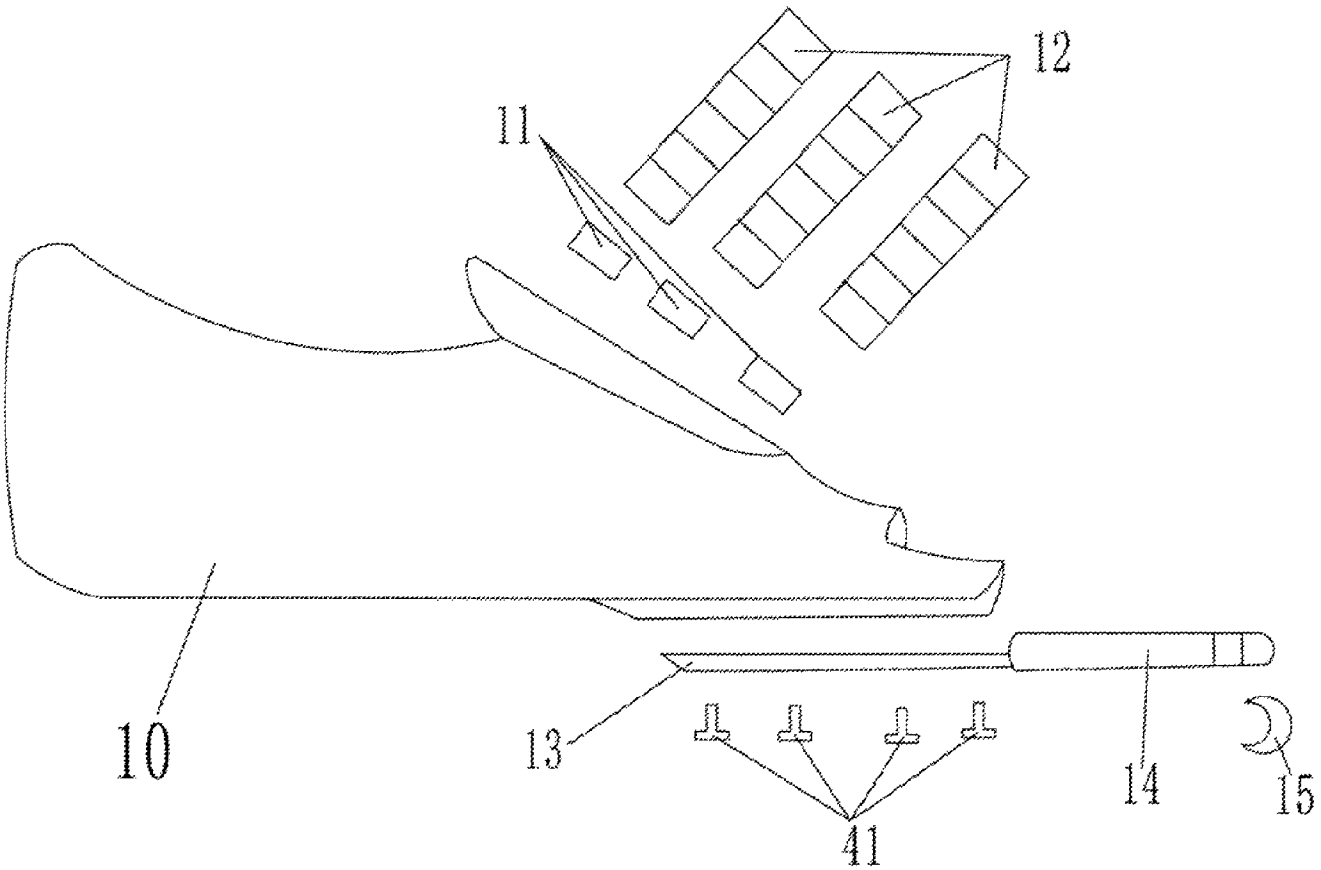
FIG. 7 shows an exploded view of the invention. All components are shown in this figure, including the buckles (11), straps (12) attachment plate (13), mounting screws (41), flexible tendons (14) and tendon clips (15).

FIG. 7 shows an exploded view of the invention. This view shows all components of the invention, from the semi-rigid foot pocket (10) to the straps (12), buckles (11), attachment plate (13), mounting screws (41), flexible tendons (14) and tendon clamps (15). This view helps to further illustrate how the components of the invention work together.

I claim:

1. A foot pocket system for accommodating a flipper, comprising:

a foot pocket, configured for accommodating a foot;

an attachment plate, attached to a bottom of said foot pocket; wherein a rear portion of said flipper is accommodated in a space between said foot pocket and said attachment plate;

a plurality of fasteners for securing said foot pocket to said attachment plate, wherein said fasteners are arranged around a perimeter of said flipper, without a direct contact with said flipper;

at least one flexible tendon, each attached to said attachment plate and mounted along edges of said flipper, and at least one tendon clip engaged with said tendon, to secure said tendon to said flipper.

2. The foot pocket system of claim 1, wherein said foot pocket system further comprises, at least one adjustable strap having a plurality of ratchets, said strap being located at the top of said foot pocket, and at least one buckle engaged with said ratchets, so that said foot is secured within said foot pocket.

3. The foot pocket system of claim 2, wherein said foot pocket system further comprises, at least one flexible tendon, each attached to said attachment plate and mounted along edges of said flipper, and at least one tendon clip engaged with said tendon, to secure said tendon to said flipper.

4. The foot pocket system of claim 3, wherein said fasteners are screws.

5. The foot pocket system of claim 3, wherein said foot pocket includes a housing having an open toe.

6. The foot pocket system of claim 5, wherein said housing is made of rigid plastic.

7. An underwater swimming aid system, comprising:

a foot pocket, configured for accommodating a foot;

a removable flipper attached to said foot pocket;

an attachment plate, attached to the bottom of said foot pocket; wherein a rear portion of said flipper is accommodated in a space between said foot pocket and said attachment plate;

a plurality of fasteners for securing said foot pocket to said attachment plate, wherein said fasteners are arranged around a perimeter of said flipper, without a direct contact with said flipper;

at least one adjustable strap having a plurality of ratchets, said strap being located at the top of said foot pocket;

at least one buckle engaged with said ratchets, so that said foot is secured within said foot pocket;

at least one flexible tendon, each attached to said attachment plate and mounted along edges of said flipper; and at least one tendon clip engaged with said tendon, to secure said tendon to said flipper.

8. The underwater swimming aid system of claim 7, wherein said foot pocket includes a housing having an open toe.

9. The underwater swimming aid system of claim 8, wherein said housing is made of rigid plastic.

10. A method of attaching a flipper to a foot pocket, comprising:

sliding said flipper into a space between said foot pocket and an attachment plate;

installing a plurality of screws to secure said foot pocket to said attachment plate, said screws being around a perimeter of said flipper, without a direct contact with said flipper;

installing at least one flexible tendon along edges of said flipper, wherein said tendon is secured to said flipper by at least one tendon clip.

* * * * *